US005687454A

United States Patent [19]

Langen

[11] Patent Number: 5,687,454

[45] Date of Patent: Nov. 18, 1997

[54] COILER CAN TRANSPORT SYSTEM BETWEEN TWO DRAWING FRAMES

[75] Inventor: Manfred Langen, Mönchengladbach, Germany

[73] Assignee: Trützschler GmbH & Co. KG, Mönchengladbach, Germany

[21] Appl. No.: 658,644

[22] Filed: Jun. 5, 1996

[30] Foreign Application Priority Data

Jun. 10, 1995 [DE] Germany ..... 195 21 185.5

[51] Int. Cl.[6] ..... D01G 21/00; B65G 65/00; B65H 75/16

[52] U.S. Cl. ..... 19/159 A; 57/281; 198/347.3

[58] Field of Search ..... 19/159 A; 57/281; 198/347.3

[56] References Cited

U.S. PATENT DOCUMENTS

| | | | |
|---|---|---|---|
| 3,698,041 | 10/1972 | Hertzsch | 19/159 A |
| 4,059,185 | 11/1977 | Weber | 19/159 A X |
| 4,995,140 | 2/1991 | Guenkinger et al. | 19/159 A |
| 5,138,558 | 8/1992 | Meyer et al. | 19/159 A X |
| 5,276,947 | 1/1994 | Fritschi et al. | 19/159 A |
| 5,297,317 | 3/1994 | Leifeld et al. | 19/159 A |
| 5,311,645 | 5/1994 | Schwalm et al. | 19/159 A |
| 5,390,484 | 2/1995 | Schwalm | 57/281 |
| 5,431,003 | 7/1995 | Raasch | 19/159 A X |
| 5,500,986 | 3/1996 | Leifeld et al. . | |
| 5,535,581 | 7/1996 | Tahara et al. | 57/281 |

FOREIGN PATENT DOCUMENTS

| | | |
|---|---|---|
| 0 389 439 | 9/1990 | European Pat. Off. . |
| 0 610 794 | 8/1994 | European Pat. Off. . |
| 0 640 550 | 3/1995 | European Pat. Off. . |

*Primary Examiner*—John J. Calvert
*Attorney, Agent, or Firm*—Spencer & Frank

[57] ABSTRACT

A drawing frame system includes first and second drawing frames, wherein the second drawing frame utilizes the sliver produced by the first drawing frame. A can filling device is situated at the output of the first drawing frame for charging consecutively supplied cans with sliver. The second drawing frame has first and second creel rows each holding a plurality of cans. Sliver is supplied to the second drawing frame from the cans alternatingly from the first and second creel rows. A coiler can transport system moves sliver-filled cans from the can filling device to the first and second creel rows and also moves empty cans from the first and second creel rows to the can filling device. The coiler can transport system includes an intake track extending to the can filling device for supplying sliver-filled cans to the can filling device; an outlet track extending from the can filling device for removing empty cans from the can filling device; as well as first and second conveyors situated along the first and second creel rows, respectively, for moving full cans into and empty cans out of the creel rows. Both the first and the second conveyor are connected to the intake track and the outlet track.

14 Claims, 7 Drawing Sheets

COILER CAN TRANSPORT SYSTEM BETWEEN TWO DRAWING FRAMES

CROSS REFERENCE TO RELATED APPLICATION

This application claims the priority of German Application No. 195 21 185.5 filed Jun. 10, 1995, which is incorporated herein by reference.

BACKGROUND OF THE INVENTION

This invention relates to a coiler can transport system arranged between a first drawing frame and a consecutively working second drawing frame. The second drawing frame has an intake table provided with two creel rows for the coiler cans. The intake table has guide rollers above the second creel row, while in the region of the first creel row a longitudinal transport device is disposed which is connected to an orthogonally arranged can supplying track. The second creel row is connected with an orthogonally arranged can removing track.

A coiler can transport system of the above-outlined type is disclosed, for example, in German Offenlegungsschrift (application published without examination) No. 39 05 279. In the system disclosed therein, the sliver input for the second drawing frame is effected at an intake table having two creel rows 26, 27. The intake table has guide rolls above the second creel row 26, and in the region of the first creel row 27 a longitudinal transport device 31 is arranged which is connected with an orthogonally disposed can supplying track 29. The second creel row 26 is connected with an orthogonally disposed can removing track 30. To supply the second creel row 26 with coiler cans filled with sliver and to remove the empty coiler cans from the second creel row 26, the known coiler can transport system includes a first, outer transport track 23 disposed parallel to the creel rows 26, 27, a second, inner transport track disposed parallel to the first transport track 23, a service aisle situated between the creel rows 26, 27, the transport tracks 23, 24, pushing devices 36–39 for the transverse shifting of coiler cans between the transport tracks 23, 24 and the creel rows 26, 27, as well as longitudinal transport devices 31–35 located in the region of the transport track. It is a disadvantage of the above-outlined prior art system that it requires substantial technical and constructional outlay. In particular, the multiple transverse shifting of the coiler cans 40 between the transport tracks 23, 24 and the creel rows 26, 27 constitute a drawback because they require additional devices which have substantial spatial requirements and are prone to operational malfunction. Further, each coiler can is exposed to multiple, rectangular deflections by the transverse track 28 which contributes disadvantageously to the long paths along which the empty and the full cans have to travel. Consequently, a rapid coiler can replacement cannot take place, thus slowing down the manufacturing process.

SUMMARY OF THE INVENTION

It is an object of the invention to provide an improved coiler can transport system of the above-outlined type from which the discussed disadvantages are eliminated and which, in particular, is of simple construction and makes possible a more rapid coiler can transport.

This object and others to become apparent as the specification progresses, are accomplished by the invention, according to which, briefly stated, the drawing frame system includes first and second drawing frames, wherein the second drawing frame utilizes the sliver produced by the first drawing frame. A can filling device is situated at the output of the first drawing frame for charging consecutively supplied cans with sliver. The second drawing frame has first and second creel rows each holding a plurality of cans. Sliver is supplied to the second drawing frame by withdrawing sliver from the cans alternatingly from the first and second creel rows. A coiler can transport system moves sliver-filled cans from the can filling device to the first and second creel rows and also moves empty cans from the first and second creel rows to the can filling device. The coiler can transport system includes an intake track extending to the can filling device for supplying sliver-filled cans to the can filling device; an outlet track extending from the can filling device for removing empty cans from the can filling device; as well as first and second conveyors situated along the first and second creel rows, respectively, for moving full cans into and empty cans out of the creel rows. Both the first and the second conveyors are connected to the intake track and the outlet track.

By effecting the coiler can transport in the longitudinal direction and avoiding all transverse shifting motions of the coiler cans, a structurally simple coiler can transport system is provided. By avoiding multiple rectangular deflections, short paths and thus a more rapid can transport is possible. It is a particular advantage of the system according to the invention that the conveyor tracks closely adjoin the intake (coiler can supplying) and outlet (coiler can removing) tracks. The coiler can transport system according to the invention is structurally simple so that undesired down periods caused by operational disturbances are, to a large measure, avoided which contributes to an increased production rate.

DESCRIPTION OF THE PREFERRED EMBODIMENT

Figure 1:
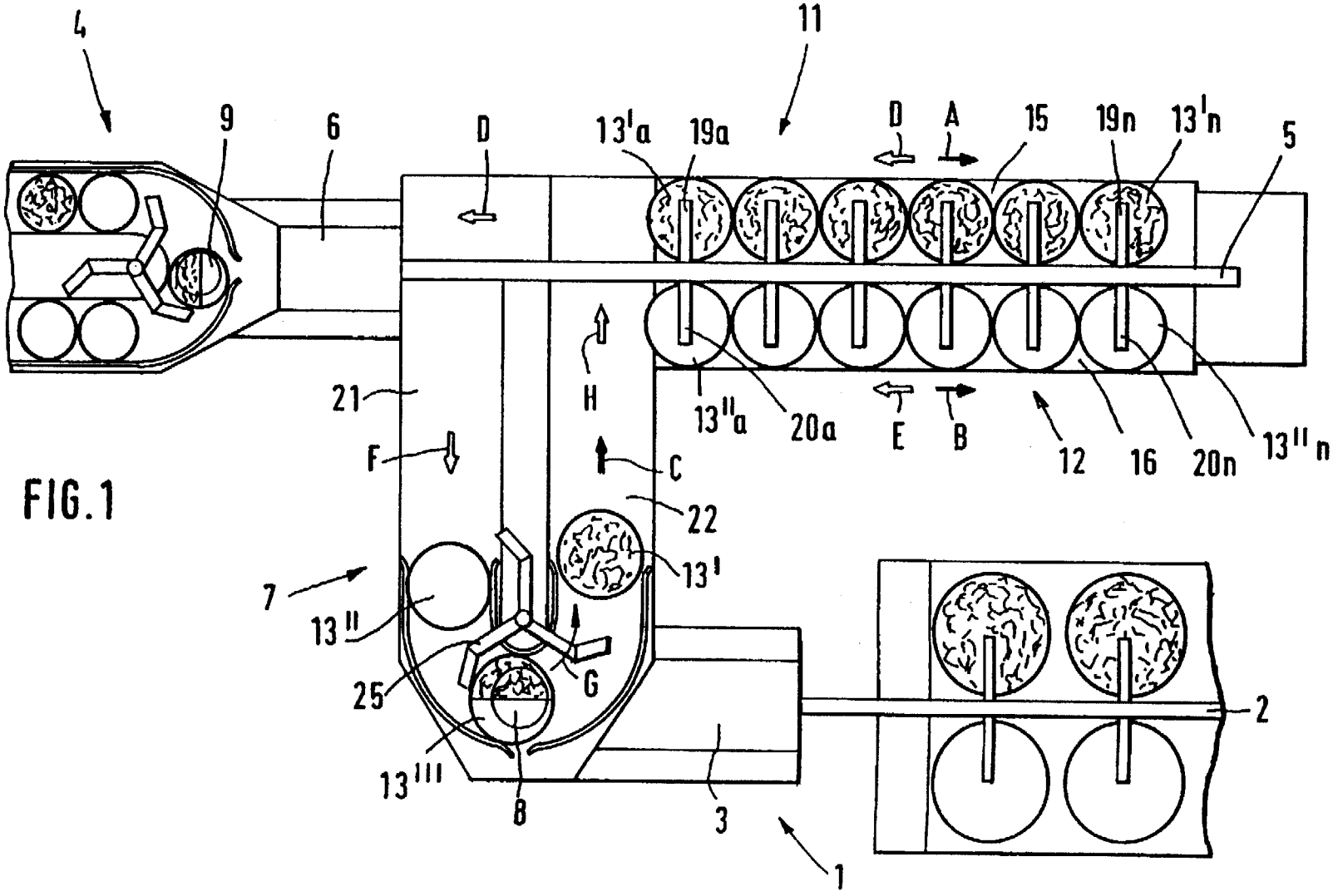
FIG. 1 is a schematic top plan view of a coiler can transport system according to a preferred embodiment of the invention.

Turning to FIG. 1, there is shown a first drawing frame 1 having a sliver intake table 2 and an only symbolically shown drawing unit 3. Further, a second drawing frame 4 is provided which has an intake table 5 and a drawing unit 6. The first drawing frame 1 is situated upstream of the second drawing frame 4 as viewed in the sequence of operation. Stated differently, the sliver produced by the first drawing frame 1 is utilized by the second drawing frame 4. Both drawing frames 1 and 4 may be HS models, manufactured by Trützschler GmbH & Co. KG, Mönchengladbach, Germany. The drawing frames 1 and 4 have respective coiler heads (can filling devices) 8 and 9 for depositing sliver outputted by the respective drawing frame. The two drawing frames 1 and 4 are coupled to one another by a coiler can transport system 7 structured according to the invention.

Figure 2:
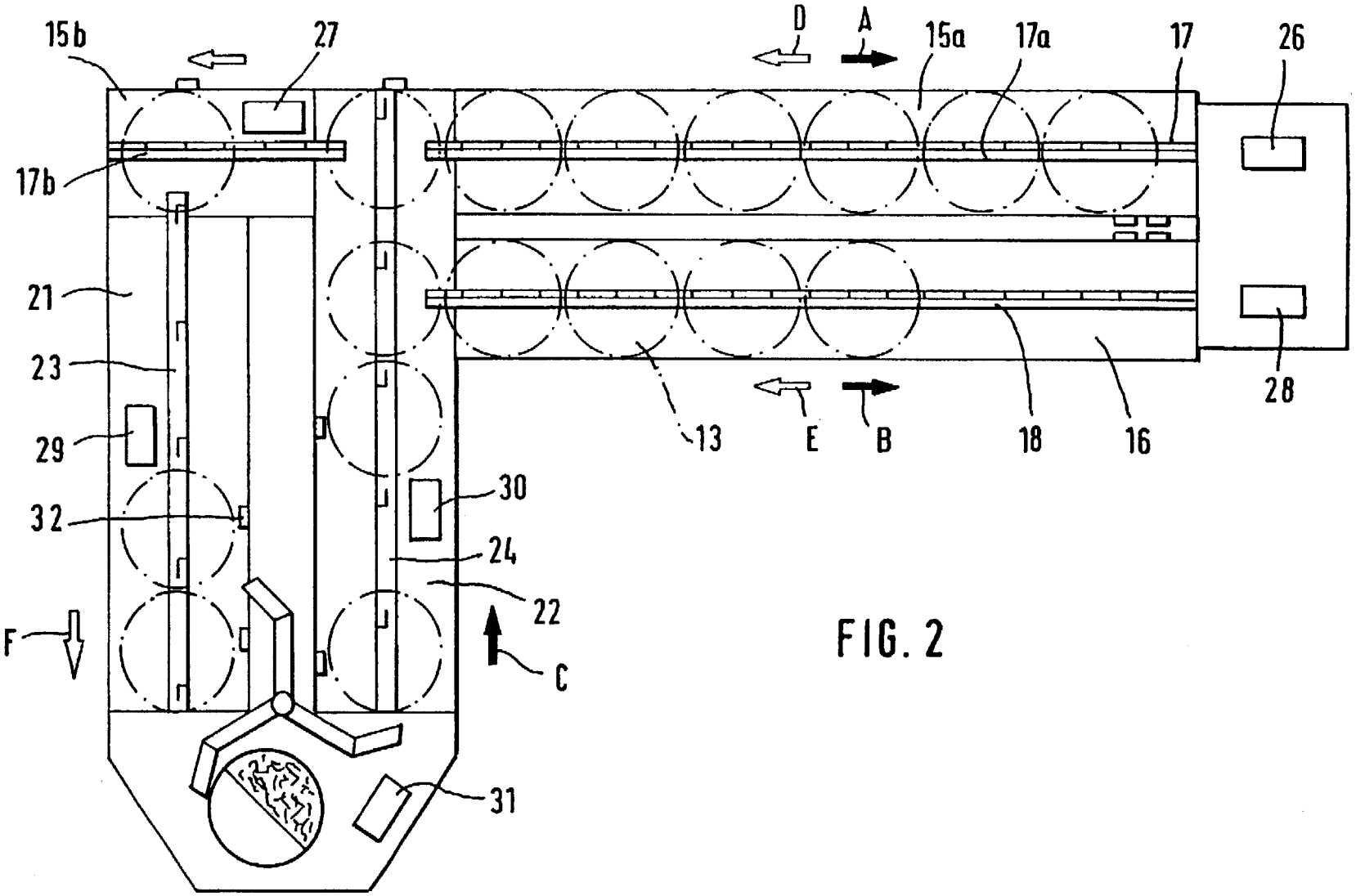
FIG. 2 is a schematic top plan view of the preferred embodiment showing additional details.
Figure 4:
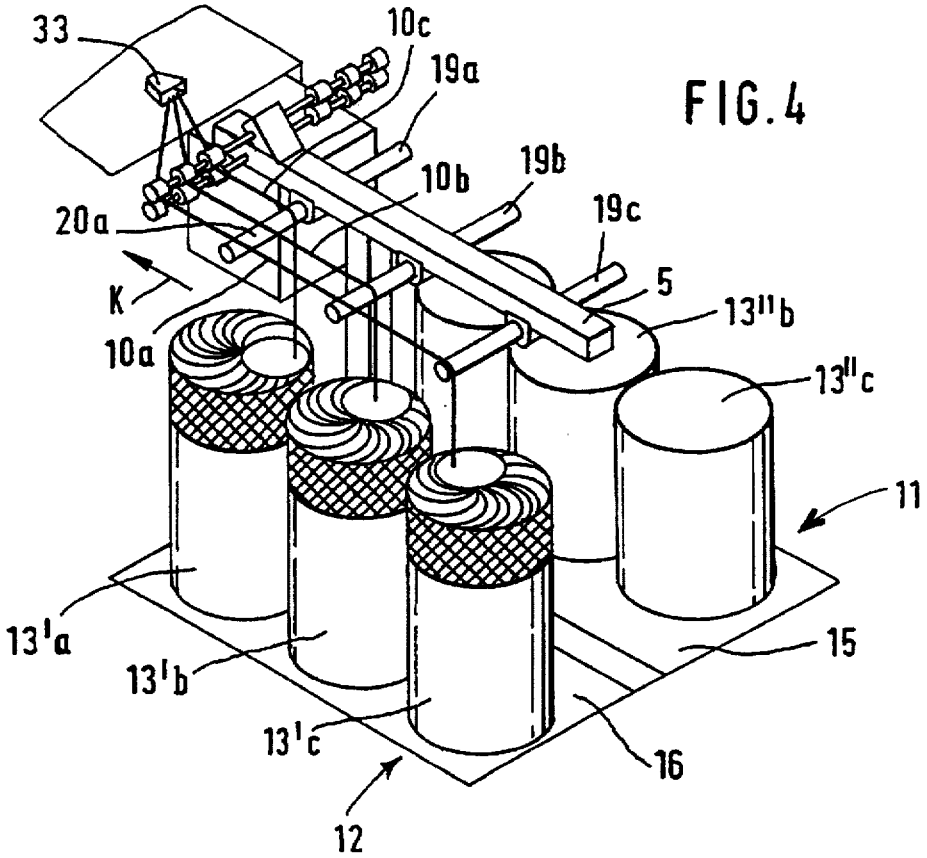
FIG. 4 is a schematic perspective view of a sliver intake assembly of a drawing frame having two creel rows and two transport tracks.

Also referring to FIGS. 2 and 4, supply of slivers 10 to the drawing unit 6 of the second drawing frame 4 is effected by means of an intake table 5 which has two creel rows 11 and 12. FIG. 4 depicts an operational phase in which full coiler cans 13'*a*–13'*n* are situated in the creel row 12, whereas empty coiler cans 13"*a*–13"*n* are situated in the creel row 11. The first and second creel rows 11 and 12 have respective first and second conveyor tracks 15 and 16. In the region of the first creel row 11 the first conveyor track 15 is associated with a first longitudinal conveyor device 17 and in the region of the second creel row 12 the second conveyor track 16 is associated with a second longitudinal conveyor device 18. The intake table 5 has, above the first creel row 11, first supply rollers 19*a*–19*n* and above the second creel row 12 there are provided second supply rollers 20*a*–20*n*. The can filling device 8 of the first drawing frame 1 is adjoined by an intake track 21 for the empty coiler cans 13" and an outlet track 22 for coiler cans 13' filled with sliver 10. The first and second conveyor tracks 15 and 16 are arranged orthogonally to the intake track 21 and the outlet track 22. Both the first and the second longitudinal conveyor devices 17 and 18 adjoin the inlet track 21 as well as the outlet track 22. The coiler can transport system 7 encompasses essentially the conveyor tracks 15, 16, the conveyor devices 17, 18, the intake track 21 and the outlet track 22. The solid-black arrows A, B and C indicate the conveying direction of the full cans 13' whereas the outlined arrows D, E, F and H indicate the conveying direction of the empty coiler cans 13". The empty cans 13" are pushed by a turnstile-like coiler can changing wheel 25 (rotating counterclockwise in the direction of the arrow G) from the intake track 21 underneath the coiler head 8. FIG. 1 shows a coiler can 13'" underneath the coiler head 8 as the can is being filled with sliver 10. Subsequently, the filled can is pushed onto the outlet track 22 by the wheel 25.

The first longitudinal conveyor 17 is formed of a first part 17*a* which is arranged in the region of the first creel row 11 in the bottom zone thereof and a second part 17*b* which is in a longitudinal alignment with the first part 17*a* and which is oriented towards the drawing unit 6 (not shown in FIG. 2). The part 17*a* adjoins immediately the outlet track 22 whereas the part 17*b* adjoins directly the intake track 21. The second longitudinal conveyor device 18 adjoins directly the outlet track 22. The transport track 15 is formed of a first part 15*a* and a second part 15*b*. The longitudinal conveyors 17, 18 extend parallel to one another and may be designed as coiler can advancing devices as disclosed, for example, in German Offenlegungsschrift No. 40 25 647. A third longitudinal conveyor 23 is associated with the intake track 21 and a fourth longitudinal conveyor 24 is associated with the outlet track 22. The fourth longitudinal conveyor 24 transports full coiler cans 23' in the direction C from the coiler head 8 to the conveyor tracks 15 and 16 and also transports empty cans 13"—which are supplied from the conveyor track 16 onto the track 22—in the direction H on the conveyor track 15*b*. The longitudinal conveyors 23 and 24 may be designed as pawl-type conveying devices as disclosed, for example, in German Offenlegungsschrift No. 43 18 056.

In operation, the coiler cans are conveyed and exchanged in a closed coiler can transport system as will be described in conjunction with FIGS. 3*a*–3*g*.

Figure 3A:
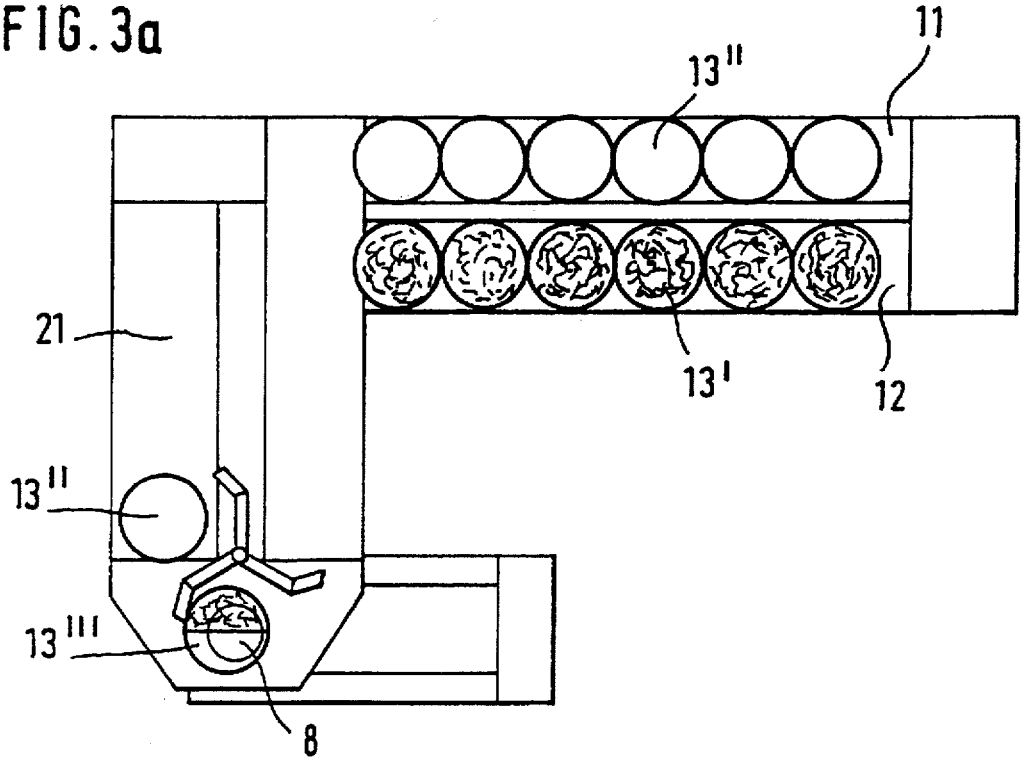
FIGS. 3*a*–3*g* are schematic top plan views of the preferred embodiment, illustrating consecutive operational phases of the can transporting process.
Figure 3B:
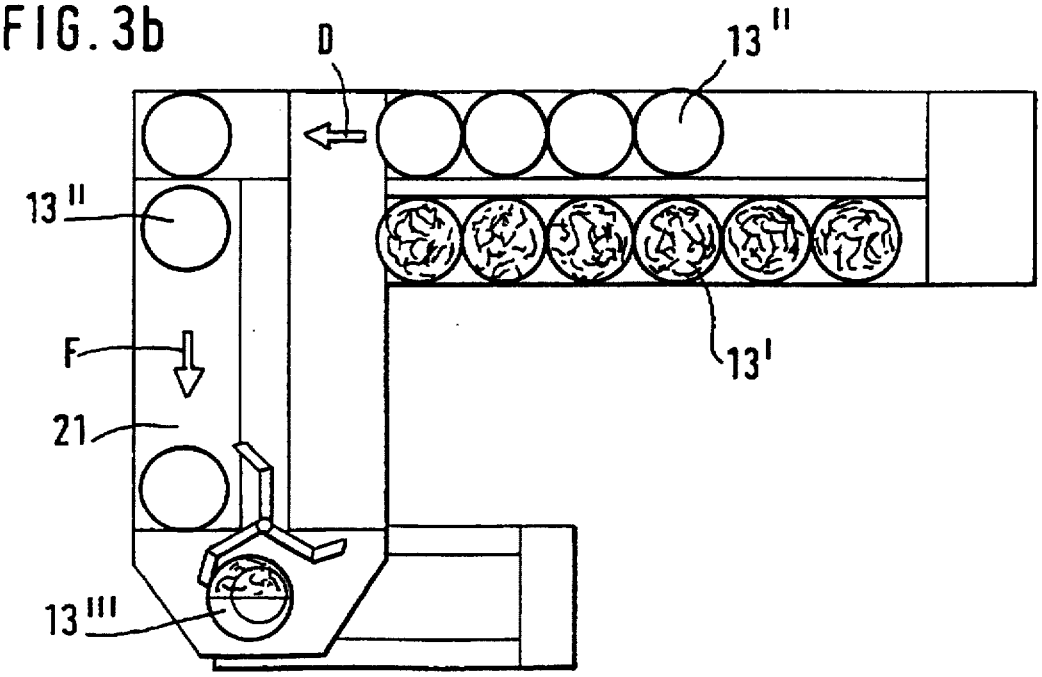
Figure 3C:
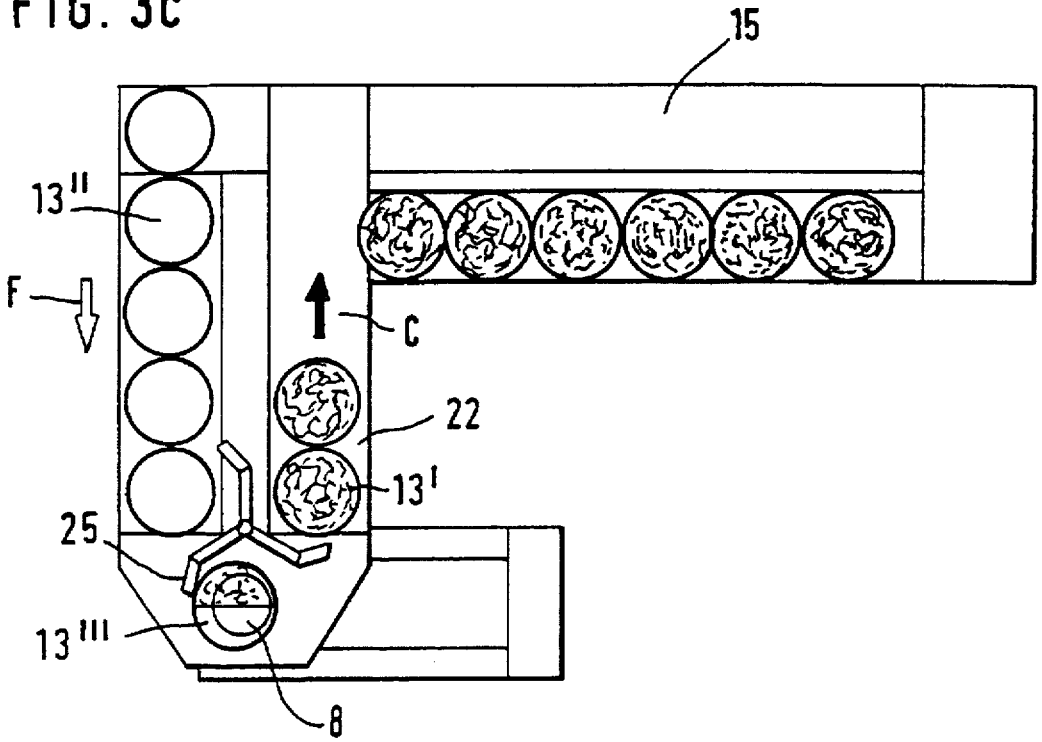
Figure 3D:
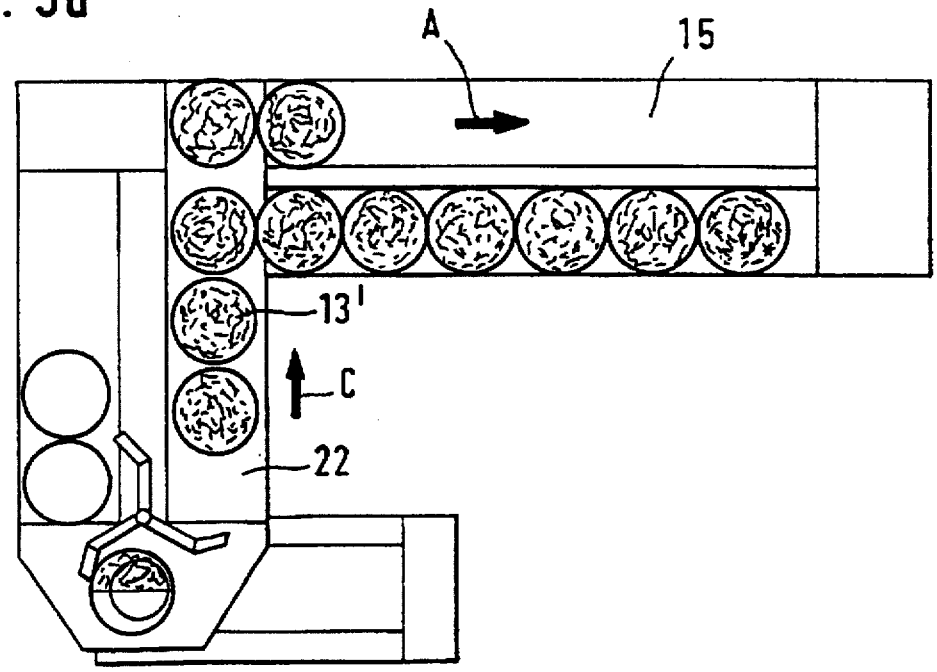
Figure 3E:
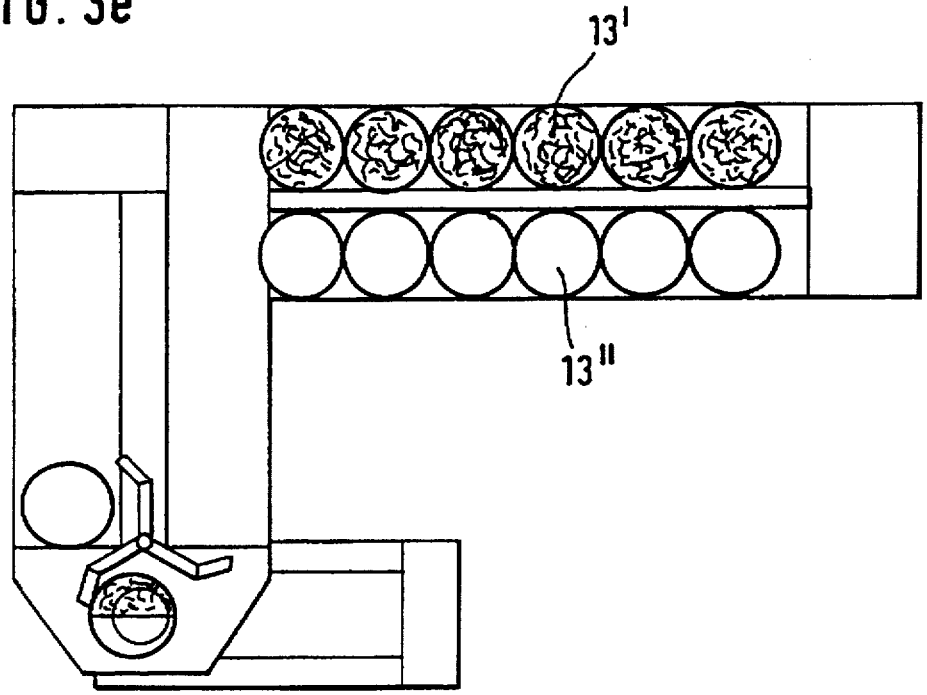
Figure 3F:
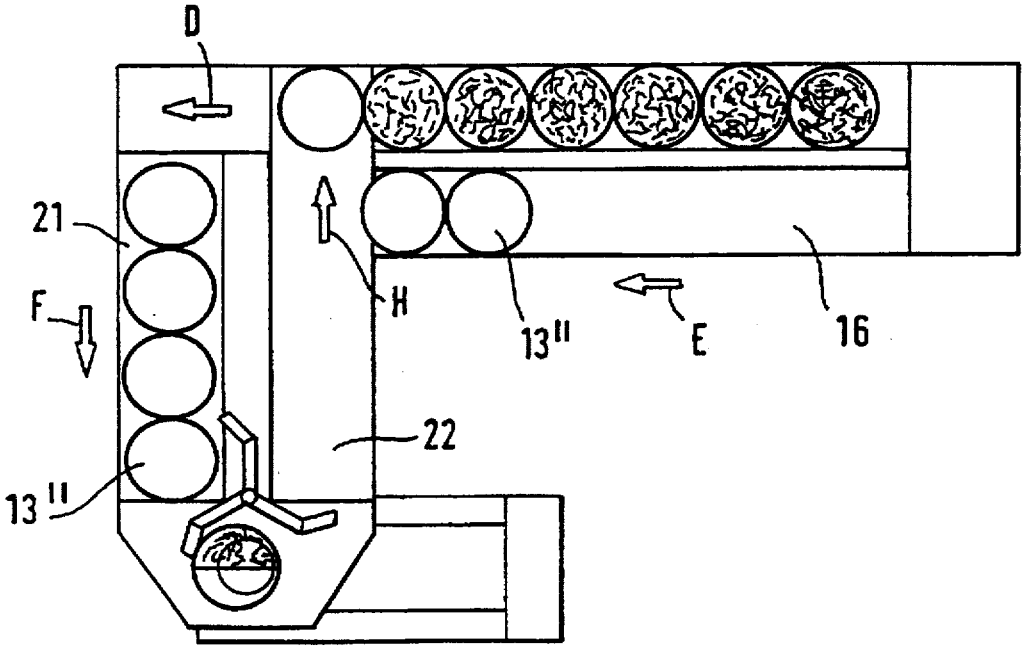
Figure 3G:
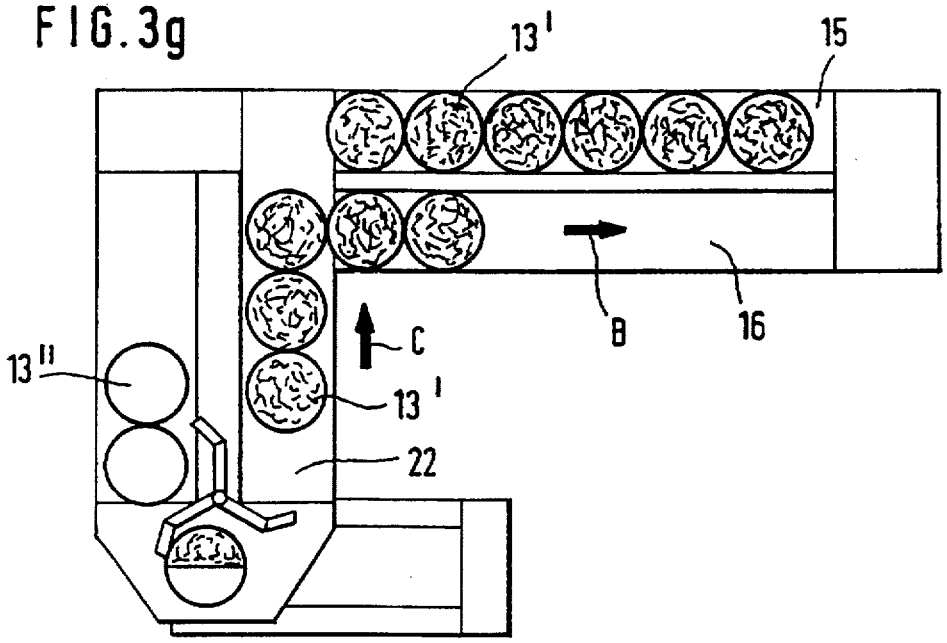

FIG. 3*a* shows the starting position. Six empty cans 13" stand on the creel row 11, six full cans 13' stand on the creel row 12, one empty can 13" stands on the intake track 21 while the coiler can 13'" is being filled with sliver underneath the coiler head 8. As shown in FIG. 3*b*, the empty cans 13" are advanced in the direction D to the intake track 21 and subsequently they are conveyed on the intake track 21 in the direction of the arrow F to assume a position illustrated in FIG. 3*c*. This conveyance lasts until no empty cans 13" are present on the conveyor track 15. The empty cans 13" on the intake track 21 are then, according to FIG. 3*c*, consecutively pushed by the rotary wheel 25 underneath the coiler head 8 and are in that position filled with sliver 10 and thereafter each filled can 13' is moved by the wheel 25 from under the coiler head 8 onto the outlet track 22. As shown in FIG. 3*d*, the full cans 13' are advanced on the outlet track 22 in the direction C to the conveyor track 15 and therefrom in the direction A onto the conveyor track 15 into the position illustrated in FIG. 3*e*. Thereafter, as shown in FIG. 3*f*, the empty cans 13" are conveyed in the direction E from the conveyor track 16 onto the outlet track 22 and then in the direction H up to the conveyor track 15*b* and then in the direction D up to the intake track 21 and finally in the direction F onto the intake track 21. This conveyance lasts until no empty can 13" is present on the conveyor track 16. Thereafter, as shown in FIG. 3*g*, full cans 13' are advanced on the conveyor track 22 in the direction C up to the conveyor track 16 and therefrom in the direction B onto the conveyor track 16. This conveyance lasts until six full coiler cans 13' are positioned on the conveyor track 16. As soon as the full coiler cans 13' which are standing on the conveyor track 15 and from which sliver 10 is introduced into the drawing unit 6 are emptied, the starting position according to FIG. 3*a* is reached whereupon a new can exchanging process may start, while the slivers are being taken for the drawing unit 6 from the coiler cans standing on the conveyor track 16 (creel row 12).

Reverting to FIG. 4, three empty cans 13"*a*, 13"*b* and 13"*c* are ready to be transported from the first conveyor track 15 (creel row 11). On the second conveyor track 16 (creel row 12) three full cans 13'*a*, 13'*b* and 13'*c* are positioned, from which slivers 10*a*, 10*b* and 10*c*, respectively, are guided by rotatable supply rollers 20*a*, 20*b* and 20*c* in the direction K into a sliver gathering input device 33 from which the combined sliver is fed to the drawing unit 6 (not shown in FIG. 4). While the slivers 10*a*, 10*b* and 10*c* of the second creel row 12 are being processed, in the first creel row 11 empty cans 13" are replaced against full cans 13' by the above-described replacement process. Thus, by the time the cans in the creel row 12 are empty, the creel row 11 has been replenished by full cans, so that sliver withdrawal may be switched to the full cans in the creel row 11.

Figure 5:
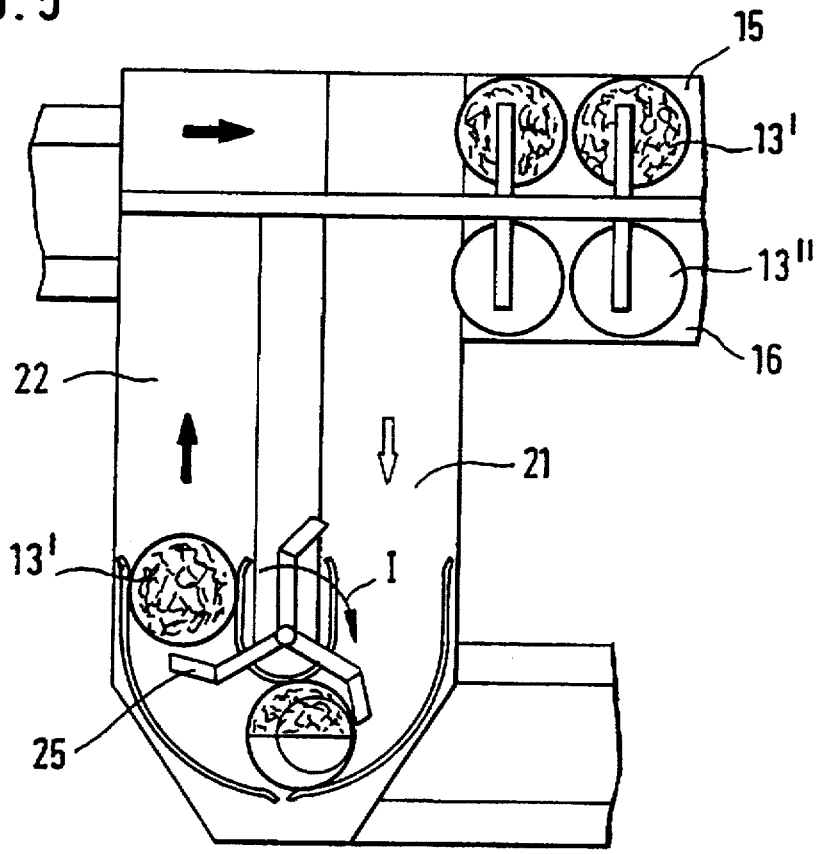
FIG. 5 is a schematic top plan view of an intake track and an output track forming part of the preferred embodiment.

As shown in FIG. 5, the rotary wheel 25 is rotated clockwise in the direction I, opposite to the rotary direction of the wheel 25 in the arrangement described before in conjunction with FIGS. 1, 2 and 3*a*–3*g*. In the arrangement according to FIG. 5 the conveyor tracks 15 and 16 adjoin directly the intake track 21.

Figure 6:
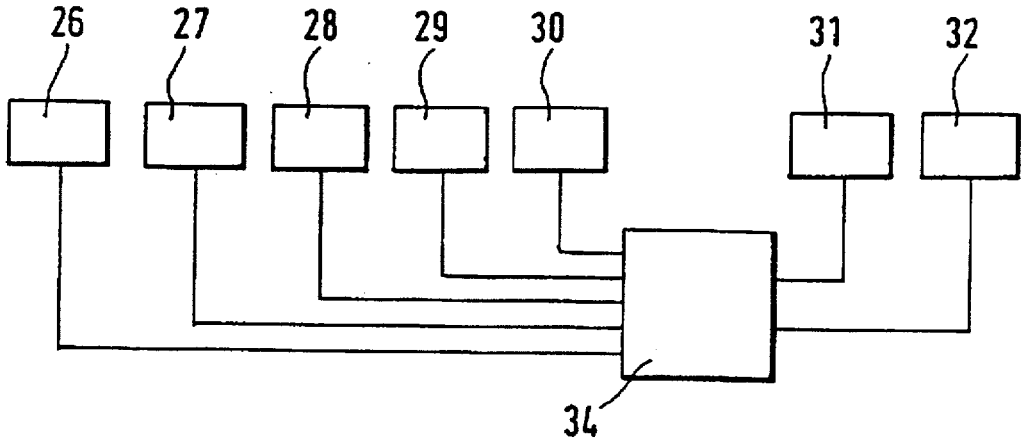
FIG. 6 is a block diagram of an electronic control of driving devices for operating the system according to the invention.

Turning to FIG. 6, there is provided an electronic control and regulating device 34, such as a microcomputer as well as drives 26, 27, 28, 29 and 30 which may be pneumatic pressure cylinders, drive motors and the like for driving the longitudinal conveyor devices 17*a*, 17*b*, 18, 23 and 24, a drive motor 31 for the can replacing wheel 25 as well as sensors 32 for the path control of the cans 13', 13". The coiler can transport system 7 according to the invention makes possible an automatic can conveyance and can replacement between the two drawing frames during their operation.

The invention further encompasses an arrangement in which—departing from FIG. 3*f*—the empty cans 13' are conveyed from the conveyor track 16 by means of a non-illustrated longitudinal conveyor in the direction E onto the intake track 21. Such non-illustrated conveyor is in alignment with the longitudinal conveyor 18.

Furthermore, the longitudinal conveyors 17 and 18 may be of one-piece construction which extends up to the intake track 21. In such arrangements, the longitudinal conveyors 23 and 24 may be designed as two-part structures.

It will be understood that the above description of the present invention is susceptible to various modifications, changes and adaptations, and the same are intended to be comprehended within the meaning and range of equivalents of the appended claims.

What is claimed is:

1. A drawing frame system comprising (a) a first drawing frame having an output discharging produced sliver;

(b) a can filling device situated at said output for charging consecutively supplied cans with sliver;

(c) a second drawing frame having an input;

(d) a first creel row for receiving a plurality of cans charged with sliver;

(e) a second creel row for receiving a plurality of cans charged with sliver;

(f) sliver supplying means for withdrawing slivers simultaneously from the plurality of cans alternatingly from said first and second creel rows and introducing the slivers into said input of said second drawing frame; and (g) a coiler can transport system for moving sliver-filled cans from said can filling device to said first and second creel rows and for moving empty cans from said first and second creel rows to said can filling device; said coiler can transport system including:

(1) an intake track extending to said can filling device for supplying sliver-filled cans to said can filling device;

(2) an outlet track extending from said can filling device for removing empty cans from said can filling device;

(3) a first conveyor situated along said first creel row for moving sliver-filled cans into and for moving empty cans out of said first creel row; said first conveyor being connected to said intake track and said outlet track; and (4) a second conveyor situated along said second creel row for moving sliver-filled cans into and for moving empty cans out of said second creel row; said second conveyor being connected to said intake track and said outlet track.

2. The drawing frame system as defined in claim 1, wherein said first conveyor immediately adjoins said intake track and said outlet track.

3. The drawing frame system as defined in claim 1, wherein said second conveyor immediately adjoins said intake track and said outlet track.

4. The drawing frame system as defined in claim 1, wherein said intake track and said outlet track are arranged orthogonally to said first and second creel rows.

5. The drawing frame system as defined in claim 1, wherein said coiler can transport system further includes (a) a can changer situated at said can filling device for moving a sliver-filled can out from under said can filling device and for moving an empty can under said can filling device;

(b) a first drive means for driving said can changer;

(c) a second drive means for driving said first and second conveyors;

(d) sensor means for ascertaining positions of the cans; and (e) an electronic control and regulating device for an automatic can conveyance by said first and second conveyors; said first and second drive means and said sensor means being connected to said electronic control and regulating device.

6. The drawing frame system as defined in claim 1, wherein at least one of said first and second conveyors comprises a can pushing mechanism.

7. The drawing frame system as defined in claim 1, wherein at least one of said first and second conveyors comprises a can pulling mechanism.

8. The drawing frame system as defined in claim 1, wherein at least one of said first and second conveyors comprises rollers forming a roller track; further comprising a drive means for driving at least some of said rollers.

9. The drawing frame system as defined in claim 1, wherein at least one of said first and second conveyors comprises an endless conveyor belt.

10. The drawing frame system as defined in claim 1, wherein at least one of said first and second conveyors comprises a wheeled carriage.

11. The drawing frame system as defined in claim 1, further comprising drive motors for driving said first and second conveyors.

12. The drawing frame system as defined in claim 1, further comprising sensor means for a path control of the cans.

13. The drawing frame system as defined in claim 1, wherein said coiler can transport system further comprises a third conveyor situated along said intake track for moving empty cans thereon toward said can filling device and a fourth conveyor situated along said outlet track for moving sliver-filled cans thereon away from said can filling device.

14. The drawing frame system as defined in claim 13, further comprising pneumatic pressure cylinders for driving said first, second, third and fourth conveyors.

* * * * *